US005339742A

United States Patent [19]

Hulderman et al.

[11] Patent Number: 5,339,742

[45] Date of Patent: Aug. 23, 1994

[54] TARGET DETECTION AND FIRE CONTROL SYSTEM FOR PARACHUTE-SUSPENDED WEAPON

[75] Inventors: Garry N. Hulderman, Riverside; Hugh L. Ord, Upland, both of Calif.

[73] Assignee: Hughes Missile Systems Company, Los Angeles, Calif.

[21] Appl. No.: 321,001

[22] Filed: Nov. 13, 1981

[51] Int. Cl.[5] ..... F42B 10/56; F42C 13/02

[52] U.S. Cl. ..... 102/387; 102/213

[58] Field of Search ..... 102/387, 386, 388, 384, 102/213, 214, 215; 244/3.16

[56] References Cited

U.S. PATENT DOCUMENTS

| | | | |
|---|---|---|---|
| 4,010,689 | 3/1977 | Sochard et al. | 102/213 |
| 4,050,381 | 9/1977 | Heinemann | 102/387 |
| 4,193,072 | 3/1980 | McKusick | 102/213 |

FOREIGN PATENT DOCUMENTS

| | | | |
|---|---|---|---|
| 2478297 | 9/1981 | France | 102/387 |

*Primary Examiner*—David Brown

*Attorney, Agent, or Firm*—Charles D. Brown; Randall M. Heald; Wanda K. Denson-Low

[57] ABSTRACT

A system for controlling the arming and firing of a weapon that is suspended from a parachute at an oblique angle and spun so as to be aimed over a spiral rotational scanning pattern on the earth as the parachute descends toward the earth. The weapon is supported by a platform so that the weapon is aimed in a predetermined direction relative to the platform. A detection system is supported by the platform and aimed in the same direction as the weapon for detecting predetermined radiation characteristics from targets of opportunity. A ranging system is supported by the platform and aimed in the same direction as the weapon for determining the range to the earth in such direction. A first circuit is coupled to the ranging system for enabling the weapon to be armed in response to the ranging system determining that the range to the earth in the direction that the weapon is aimed is less than a first predetermined distance; and a second circuit is coupled to the detection system and the ranging system for enabling an armed weapon to be fired in response to either the detection system detecting the predetermined radiation characteristics or the ranging system determining that the range to the earth in the direction that the weapon is aimed is less than a second predetermined distance that is shorter than the first predetermined distance.

5 Claims, 7 Drawing Sheets

TARGET DETECTION AND FIRE CONTROL SYSTEM FOR PARACHUTE-SUSPENDED WEAPON

The Government has rights in this invention pursuant to Contract No. DAAK10-78-C-0050, awarded by the U. S. Army.

BACKGROUND OF THE INVENTION

The present invention generally pertains to a target detection and fire control system for a parachute-suspended weapon.

It is known in the prior art to suspend a weapon and a detection system from a parachute at an oblique angle over a target area and to spin the weapon and detection system to scan the target area in a rotational pattern for targets of opportunity. It also is known to detect certain types of targets by detecting predetermined radiation characteristics thereof such as infrared radiation. It is additionally known to detect such targets by determining whether a detection signal provided in response to detection of the characteristic radiation not only exceeds a predetermined low threshold but also is less than a predetermined high threshold that may be indicative of a false target. It is further known to measure the range from a moving weapon to a selected target while the weapon is closing in on the target and to fire the weapon when it is determined that the weapon is less than a predetermined distance from the target.

SUMMARY OF THE INVENTION

The present invention is an improved system for controlling the arming and firing of a weapon that is suspended from a parachute at an oblique angle and spun so as to be aimed over a rotational scanning pattern on the earth as the parachute descends toward the earth. The system includes a platform for supporting the weapon so that the weapon is aimed in a predetermined direction relative to the platform; a detection system supported by the platform and aimed in the same direction as the weapon for detecting predetermined radiation characteristics from targets of opportunity; a ranging system supported by the platform and aimed in the same direction as the weapon for determining the range to the earth in such direction; a first circuit coupled to the ranging system for enabling the weapon to be armed in response to the ranging system determining that the range to the earth in the direction that the weapon is aimed is less than a first predetermined distance; and a second circuit coupled to the detection system and the ranging for enabling an armed weapon to be fired in response to either the detection system detecting the predetermined radiation characteristics or the ranging system determining that the range to the earth in the direction that the weapon is aimed is less than a second predetermined distance that is shorter than the first predetermined distance. The term "earth" means the surface of the planet or any object on the surface whether such object be natural or man-made. The system of the present invention provides certain important advantages in the manner that it responds to range determinations. Because the weapon is not armed by the system until the weapon is within the first predetermined distance from the earth, the weapon will not be prematurely fired at an excessive altitude in response to detection signals provided by high radiation from a false target, which would exceed the predetermined high threshold at altitudes below the first predetermined distance, but which do not exceed the predetermined high threshold at higher altitudes. Also by firing the weapon in response to determination that the weapon has descended to the second predetermined distance, the weapon will be fired even if no target has been detected and thereby will not land on the earth in an undetonated condition.

Additional features of the present invention are described in connection with the description of the preferred embodiment.

DESCRIPTION OF THE PREFERRED EMBODIMENT

Figure 1:
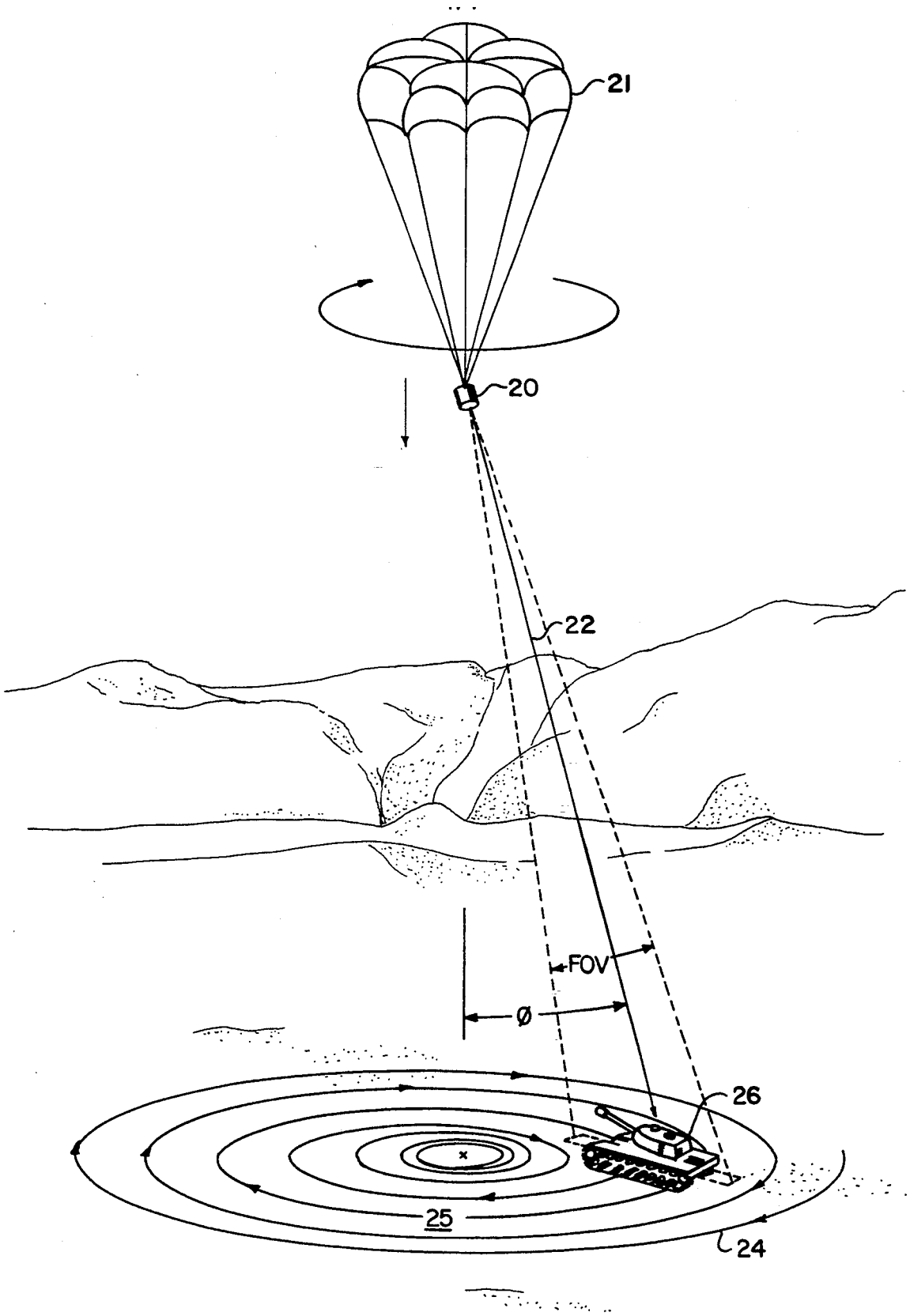
FIG. 1 illustrates the use of the present invention in detecting a target as a parachute supported weapon platform descends to earth.

In a preferred embodiment, the control system of the present invention is contained in a cylindrical weapon platform 20, which is shown in FIG. 1 as suspended from a parachute 21. The cylindrical platform 20 supports a weapon that is aimed along the longitudinal axis 22 of the platform 20. The cylindrical platform 20 further supports a detection system and a ranging system, both of which are aimed in the same direction as the weapon.

The platform 20 is suspended from the parachute 21 at an oblique angle $\phi$ of approximately thirty degrees and is spun at a predetermined rate, such as four revolutions per second, so that the weapon, the detection system and the ranging system all are aimed over a spiral rotational scanning pattern 24 on the earth 25 as the parachute 21 descends toward the earth 25.

The detection system detects predetermined radiation characteristics, such as infrared radiation, from targets of opportunity, such as a tank 26, within the radial field of view FOV of the detection system generally about an extension of the longitudinal axis 22 of the platform 20. The ranging system determines the range to earth 25 from the platform 20 generally along an extension of the longitudinal axis 22 of the platform 20.

Figure 2:
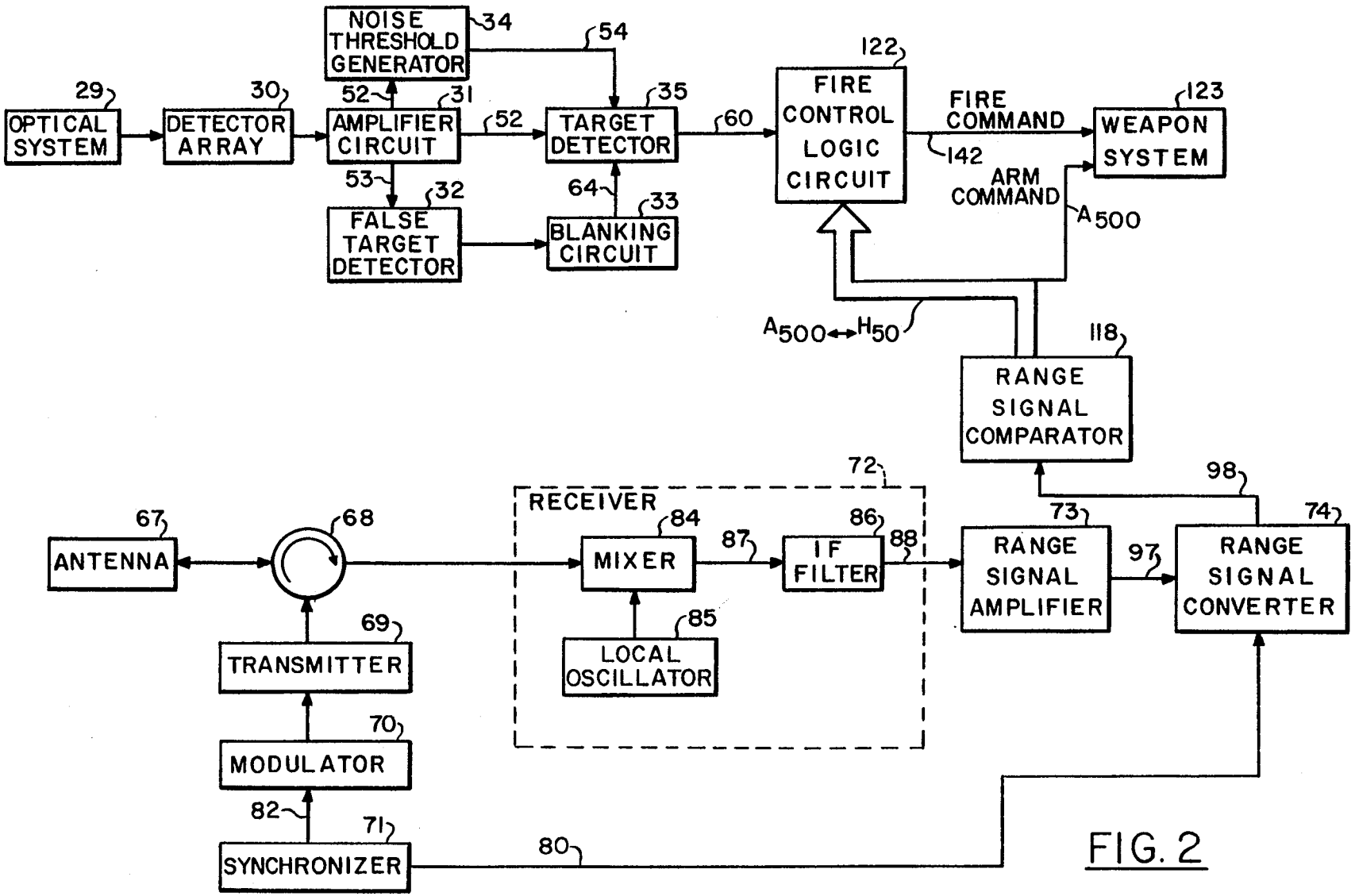
FIG. 2 is a block diagram of a preferred embodiment of the system of the present invention.

The preferred embodiment of the system of the present invention for controlling the arming and firing of the weapon is described with reference to FIG. 2.

The detection system includes an optical system 29, a detector array 30, an amplifier circuit 31, a false target detector 32, a blanking circuit 33, a noise threshold generator 34 and a target detector 35.

Figure 3:
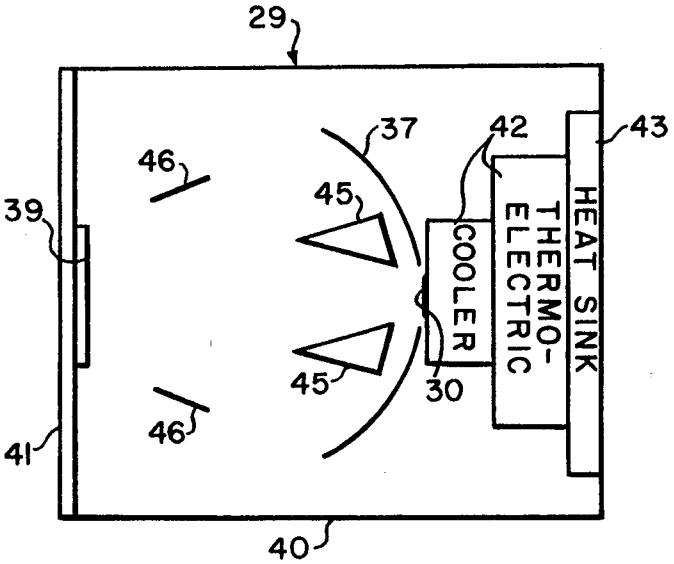
FIG. 3 schematically illustrates the optical system included in the preferred embodiment of FIG. 2.

Referring to FIG. 3, the optical system 29 is a Cassegrain system having a parabolic primary mirror 37 and a flat secondary mirror 39. The optical system 29 is contained in a cylindrical housing 40, having a transparent cover 41. The detector array 30 is positioned on a thermoelectric cooler 42 in the focal plane of the optical system. The thermoelectric cooler 42 is mounted on a heat sink 43. Sun shades 45, 46 are positioned to prevent any rays that strike the inside of the housing 40 from being reflected directly to the focal plane of the optical system without causing any significant reduction in the transmission of rays within the selected field of view from reaching the focal plane.

Infrared radiation from a target passes through the transparent cover 41 and is reflected from the primary minor 37 to the secondary mirror 39. After reflection from the secondary mirror 39, the infrared energy comes to a focus at the detector array 30.

This optical system is quite compact. The secondary mirror 37 is approximately one-half the diameter of the primary mirror 39 and thereby obscures only twenty-five percent of the optical aperture area. The optical aperture is one inch (2.54 cm). The focal length in two inches. The optical system has an f number of at least 1.75; and an f number of 2 is preferred. The primary mirror 37 and secondary mirror 39 have an on-axis resolution of 1.4 milliradians.

Figure 4:
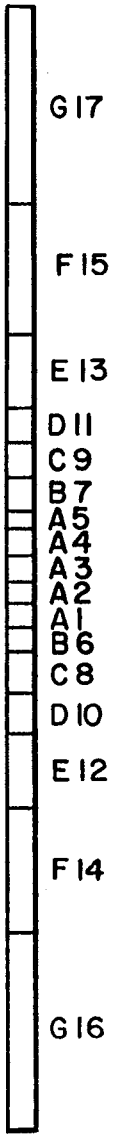
FIG. 4 illustrates the layout the detector array included in the preferred embodiment of FIG. 2.

The configuration of the detector array 30 is shown in FIG. 4. The detector array has seven adjacent groups of PbSe infrared detector elements of different sizes. A first group of detector elements A1, A2, A3, A4, A5 located in the middle portion of the array 30 has the smallest size elements. Each of the other groups includes two detector elements B6 and B7, C8 and C9, D10 and D11, E12 and E13, F14 and F15, and G16 and G17 respectively disposed outward from the first group of detector elements A1, A2, A3, A4, A5. In the preferred embodiment, each of the five detectors in the first group are 0.005 inches square. In each of the other groups, the two detector elements are respectively located adjacent opposite ends of the adjacent inner group and are larger than the elements in the adjacent inner group. By way of illustration, the two detector elements in the outer group G16 and G17 are respectively located adjacent opposite ends of the adjacent inner group F14 and F15 and are larger than the elements F14 and 15 in the adjacent inner group.

Figure 5:
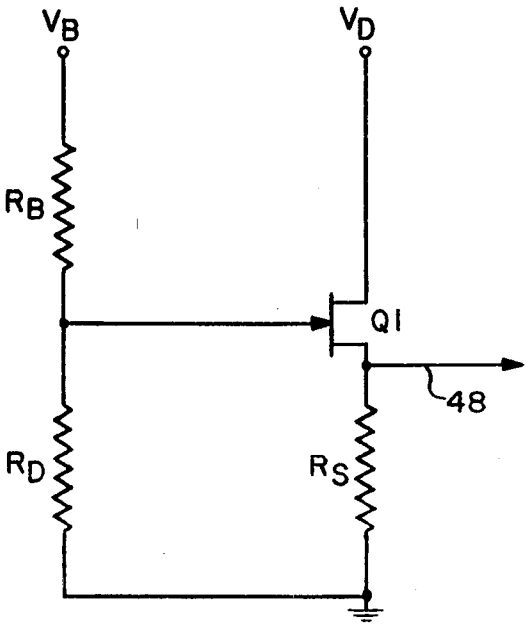
FIG. 5 is a schematic circuit diagram of a preamplifier circuit included in the amplifier circuit included in the preferred embodiment of FIG. 2.

The detection system includes a separate detector channel for each of the seventeen detector elements of the detector array 30. Accordingly, the amplifier circuit 31 contains a separate preamplifier circuit, as shown in FIG. 5 for each of the seventeen detector elements. Each preamplifier circuit includes a field effect transistor FET Q1 connected to the detector element $R_D$ as a voltage follower for providing a detection signal on line 48. The detector element $R_D$ is connected between the gate of the FET Q1 and circuit ground. A bias resistance $R_B$ is connected between the gate of the FET Q1 and a bias voltage source $V_B$. The drain of the FET Q1 is connected to a supply voltage source $V_D$; and the source of the FET Q1 is coupled to circuit ground by a source resistance $R_S$.

The signal-to-noise ratio at the preamplifier input (the gate of the FET Q1) is maximized by matching the bias resistance $R_B$ to the impedance of the detector element $R_D$at the operating temperature of the detector element $R_D$. It should be noted that the impedance of the detector element is not the same in each channel. The detector elements in the outwardly disposed groups of detector elements of the detector array 30 have a lower impedance than the inwardly disposed detector elements. Thus the bias resistance $R_B$ must be selected individually for each channel in accordance with the respective detector element impedance $R_D$ for such channel.

The impedance of the detector element $R_D$ changes when infrared energy strikes the detector element. An incremental increase in infrared energy P impinging on the detector element $R_D$ results in an incremental decrease in the impedance of the detector element.

$$R_D = -k/\Delta P$$

Accordingly, a pulsed change in the infrared energy striking the detector element $R_D$as the detection system scans over the target area produces a pulsed detection signal on line 48 from the preamplifier circuit. The amplitude of the detection signal pulse on line 48 is proportional to the intensity of the impinging infrared radiation.

Figure 6:
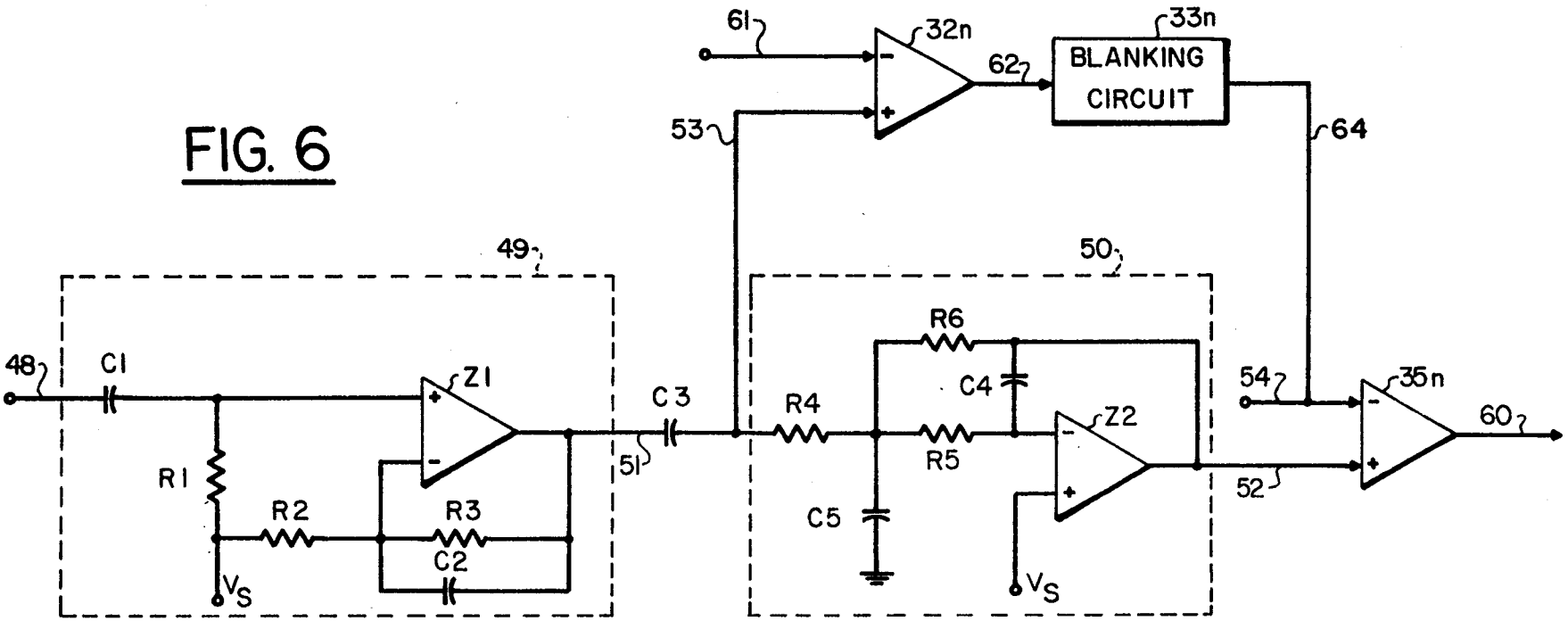
FIG. 6 is a combination schematic circuit diagram and block diagram of portions of the amplifier circuit the target detector and the false target detector included with the blanking circuit in the preferred embodiment of FIG. 2.

The amplifier circuit 31 also includes a separate pulse amplifier circuit, as shown in FIG. 6, for each of the seventeen separate detector channels. Each pulse amplifier circuit includes a first stage 49 and a second stage 50. The first stage includes an operational amplifier Z1, an input capacitance C1, a feedback capacitance C2, input resistances R1 and R2 and a feedback resistance R3.

The detection signal from the output line 48 of the preamplifier circuit is provided to the input of the first stage 49 by a miniature coaxial cable. The detection signal from line 48 is provided through the input capacitance C1 to the noninverting input of the operational amplifier Z1. A parallel RC feedback circuit consisting of the capacitance C2 and the resistance R3 is connected between the output and inverting input of the operational amplifier Z1. The input resistances R1 and R2 respectively couple the noninverting and inverting inputs of the operational amplifier Z1 to a reference voltage supply $V_S$.

The first stage 49 has a low frequency passband response of 15 Hz to 8000 Hz to prevent differentiation of pulses in the detection signal received from the preamplifier circuit on line 48. The first stage 49 has a gain of approximately 40.

The output line 51 of the first stage 49 is coupled to the input of the second stage 50 by a coupling capacitance C3. The second stage 50 includes an operational amplifier Z2 a feedback capacitance C4 and input capacitance C5 input resistances R4 and R5 and a feedback resistance R6. The noninverting input of the operational amplifier Z2 is connected to a reference voltage supply $V_S$. The capacitance C4 is connected between the output and inverting input of the operational amplifier Z2. The resistances R4 and R5 are connected series between the coupling capacitance C3 and the inverting input of the operational amplifier Z2. The feedback resistance R6 is connected between the output of the operational amplifier Z2 and the junction of the resistances R4 and R5. The capacitance C5 is connected between the junction of the resistances R4 and R5 and circuit ground.

The second stage 50 forms a second order cut-off filter with the upper end of the passband rolling off at 2000 Hz. The second stage has a gain of approximately 20 to sinusoidal signals and approximately 15 to a hayersine pulse of a 400 microsecond base pulse width.

The coupling capacitance C3 eliminates 60 Hz signals that may otherwise be picked-up when the amplifier circuit is tested prior to use.

Figure 7:
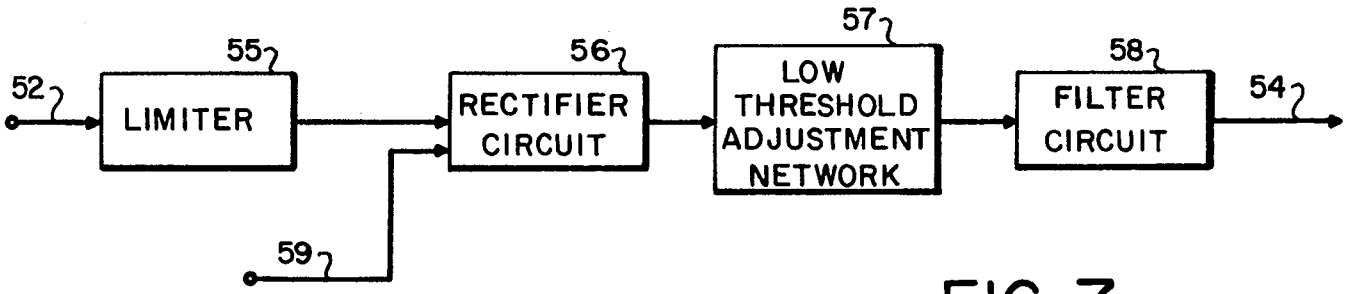
FIG. 7 is a block diagram of the noise threshold generator included in the preferred embodiment of FIG. 2.

The detection system also includes a false target detector 32, a blanking circuit 33 and a target detector 35 for each of the seventeen detector channels. Referring again to FIG. 6, each target detector 35 includes a comparator $35_n$. The noninverting input of the comparator $35_n$ receives the amplified detection signal from the output line 52 of the second amplifier stage 50. A low threshold signal is provided on line 54 as a reference signal to the inverting input of the comparator $35_n$. The low threshold signal on line 54 is provided from a noise threshold generator 34 which is shown in FIG. 7.

The noise threshold generator 34 includes a series combination of a limiter 55, a rectifier circuit 56, a low threshold adjustment network 57 and a filter circuit 58. An amplified detection signal is provided to the limiter 55 on line 52 from the output of the second stage 50 of the pulse amplifier circuit in the detector channel connected to the center detector element A1 of the detector array 30. The limiter 55 limits the amplitude of the detection signal provided to the rectifier circuit 56. The rectifier circuit 56 rectifies detection signal pulses above a level predetermined by the level of the reference voltage signal provided on line 59 from a control circuit (not shown). The filter circuit 58 filters all non-DC components out of the rectified detection signal and thereby provides a DC low threshold signal on line 54. The level of the low threshold signal may be adjusted by the low threshold adjustment network 57. Accordingly, the noise threshold generator 34 amplifies the detection signal from line 52 in the detector channel including the detector element A1 for providing as the low threshold signal a signal having a predetermined signal-to-noise ratio in relation to a detection signal on line 52 that is responsive to background noise detected in the absence of a target having the predetermined radiation characteristics of frequency (infrared) and intensity. The low threshold signal on line 54 is respresentative of a minimum low level of infrared radiation that is indicative of a valid target. Because the low threshold signal is proportional to the background noise level, it increases in amplitude as the detection system descends toward the earth. Thus the minimum radiation level that must be detected to recognize a target as valid increases as the detection system moves closer to any targets of opportunity on the Earth's surface.

The comparator $35_n$ compares the respective levels of the detection signal on line 52 and the low threshold signal on line 54. When the comparator $35_n$ determines that the detection signal on line 52 exceeds the low threshold signal on line 54, the comparator $35_n$ provides a target detection signal on line 60.

Each false target detector 32 includes a comparator $32_n$. The noninverting input of the comparator $32_n$ receives the detection signal on line 53 via the coupling capacitance C3 from the output line 51 of the first amplifier stage 49. The coupling capacitance C3 isolates the comparator $32_n$ from DC voltage variations within the first stage 49. A high threshold signal is provided on line 61 from a control circuit (not shown) as a reference signal to the inverting input of the comparator $32_n$. The high threshold signal on line 61 is representative of a maximum high infrared radiation level that is indicative of a valid target at a first predetermined distance of 500 feet from the target. Higher radiation levels are treated as being indicative of false targets, such as a fire or flare.

The comparator $32_n$ compares the respective levels of the detection signal on line 53 and the high threshold signal on line 61. When the comparator $32_n$ determines that the detection signal on line 53 exceeds the high threshold signal on line 61, the comparator $32_n$ provides a false target signal on line 62 to the blanking circuit $33_n$ in its detector channel. The blanking circuit $33_n$ responds to a false target detection signal on line 62 by providing a blanking signal pulse on line 64 to the inverting input of the comparator $35_n$ for preventing the comparator $35_n$ from providing a target detection signal on line 60 notwithstanding the level of the detection signal on line 52 relative to the level of the low threshold signal provided on line 54.

The second amplifier stage 50 delays the provision of the detection signal to the comparator $32_n$ until after the comparison of the detection signal on line 53 with the high threshold signal on line 61 by the comparator $32_n$. The blanking signal pulse provided on line 64 by the blanking circuit has a duration exceeding the period of such delay so that the comparator $35_n$ will not respond to the trailing portion of the detection signal on line 52 after having been prevented from responding to the leading portion thereof. Accordingly, the target detector 35 is prevented from providing a target detection signal in response to detection of any target until after the false target detector 32 has had time to determine whether the detection signal exceeds the high threshold signal that is indicative of a false target.

Because the second amplifier stage provides an additional gain of approximately 15, the level of the amplified detection signal on line 53 compared by the target detector comparator $35_n$ is approximately 15 times the level of the detection signal on line 53 compared by the false target detector comparator $32_n$. As a result the dynamic range for false target detection is approximately fifteen times the dynamic range for valid target detection.

Referring again to FIG. 2, the ranging system of the preferred embodiment includes an antenna 67 a microwave signal circulator 68, a transmitter 69, a modulator 70, synchronizer 71, a receiver 72, a range signal amplifier 73 and a range signal converter 74.

Figure 8:
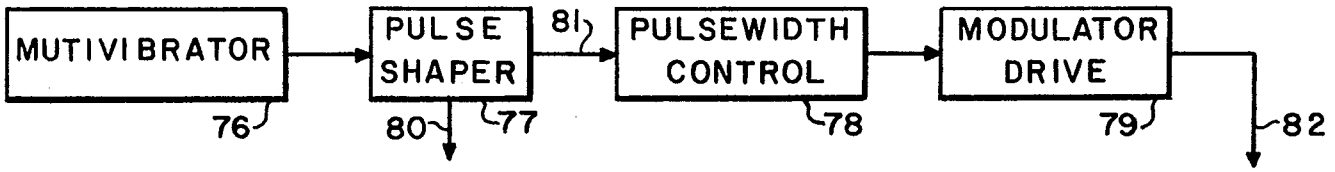
FIG. 8 is a block diagram of the synchronizer included in the preferred embodiment of FIG. 2.

The construction of the synchronizer 71 is shown in FIG. 8. The synchronizer includes a multivibrator 76, a pulse shaper 77, a pulse width control circuit 78 and a modulator drive circuit 79. The multivibrator 76 produces periodic signal pulses having a predetermined pulse repetition frequency (prf). The pulses are shaped by the pulse shaper 77 to provide a 200 kHz prf square wave sync signal. The square wave sync signal is provided on line 80 to the range signal converter 74 and on line 81 to the pulse width control circuit 78. The pulse width control circuit 78 generates 50 nanosecond wide pulses at the 200 kHz pulse repetition frequency of the sync signal on line 81. The modulator drive circuit 79 amplifies the 50 nanosecond pulses and provides a pulse signal on line 82 for triggering the modulator 70. The modulator 70 is a Darlington power amplifier which is connected to the transmitter 69 for causing energy to be transfitted from the antenna 67 during each 50 nanosecond pulse period.

The transmitter operates at a carrier frequency of 37 gHz. The transmitter includes as GaAs Gunn diode.

The antenna 67 consists of a parallel-fed array of microstrip elements phased so as to produce a pencil beam squinted thirty degrees off broadside. The feed network is of microstrip construction on the same substrate as the radiating elements of the antenna. Power split is accomplished at symmetrical junctions without transformer sections. Line taper is used to provide broadband impedance transformation, as required.

The circulator 68 is a ferrite duplexer for transferring the transmitted signal from the transmitter 69 to the antenna 67 and for transferring the received signal from the antenna 67 to the receiver 72.

The receiver 72 includes a mixer 84, a local oscillator 85 an IF filter 86. Transmitted energy that is reflected back from the earth is received by the antenna 67 and transferred to the mixer 84 where it is mixed with a 37 GHz signal from the local oscillator 85 to provide a mixed signal on line 87 to the IF filter 86. The IF filter 86 detects the reflected echo pulses for determining the range from the ranging system antenna 67 to the earth and provides a range signal containing the echo pulses on line 88 to the range signal amplifier 73.

Figure 9:
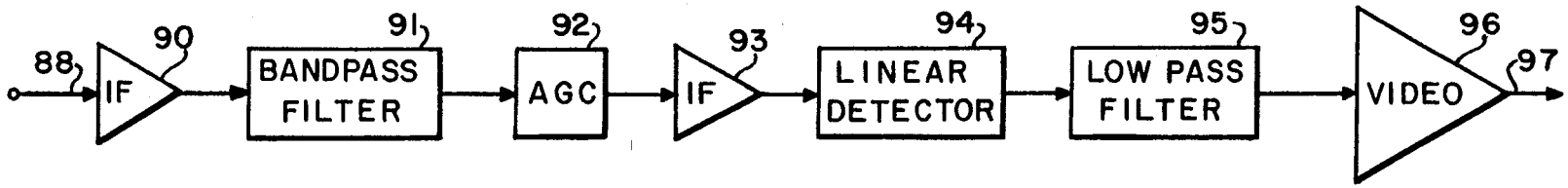
FIG. 9 is a block diagram of the range signal amplifier included in the preferred embodiment of FIG. 2.

The construction of the range signal amplifier 73 is shown in FIG. 9. The range signal amplifier includes a first IF amplifier 90, a bandpass filter 91, an automatic gain control (AGC) circuit 92, a second IF amplifier 93, a linear detector 94, a lowpass filter 95 and a video amplifier 96. The first IF amplifier 90 amplifies the range signal to provide 35 dB of gain. The first IF amplifier 90 includes a low noise first stage for setting the noise figure at 2.5 db. The amplified signal from the first IF amplifier 90 is fed through the bandpass filter 91, which suppresses local oscillator 85 and mixer 84 noise components outside of the 100 MHz to 500 MHz band. The filtered signal from the bandpass filter 91 is fed through the AGC control circuit 92, which permits signal attenuation to 30 db. The second IF amplifier 93 amplifies the signal from the AGC circuit 92 to provide another 35 dB of gain. The linear detector 94 converts the signal from the second IF amplifier 93 to a video signal. The low pass filter 95 is a 20 MHz low pass filter for matching the 50 nsec pulse width of the video signal from the linear detector 94. The video amplifier 96 amplifies the signal from the low pass filter 95 to provide a video range signal on line 97 having additional gain and increased dynamic range.

Figure 10:
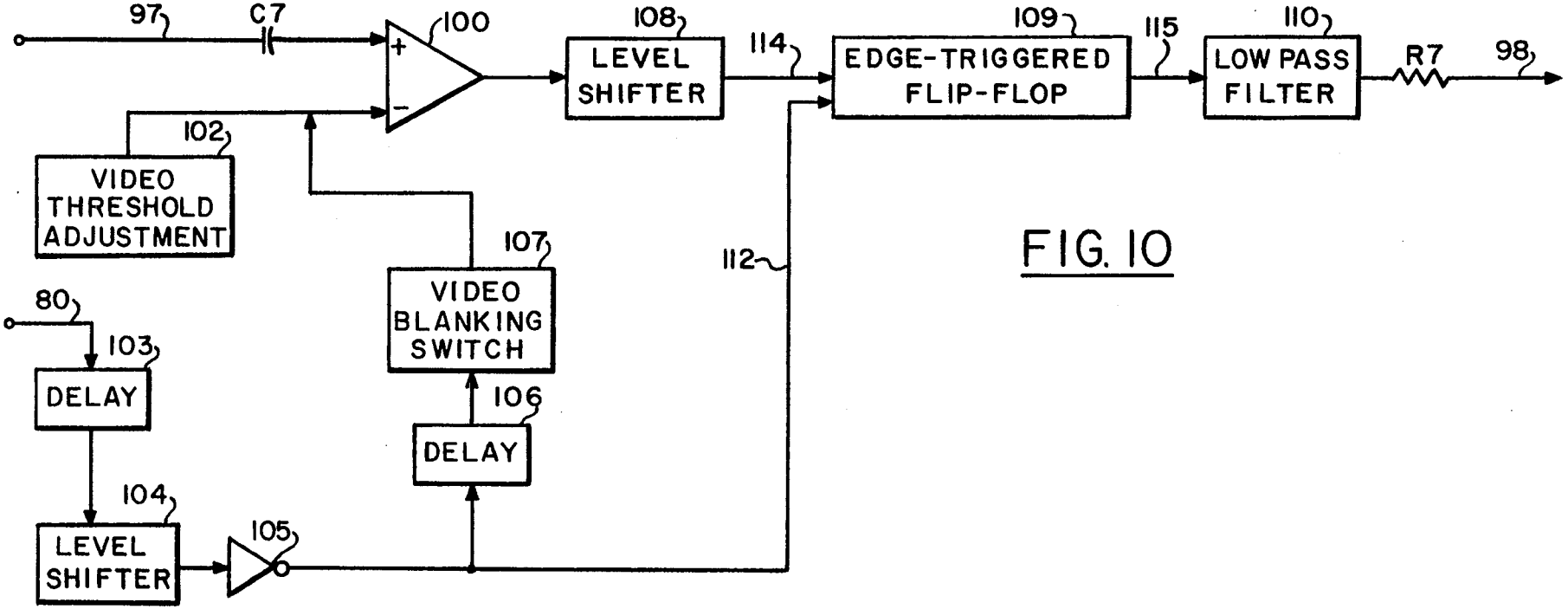
FIG. 10 is a block diagram of the range signal converter included in the preferred embodiment of FIG. 2.

The video range signal on line 97 is converted by the range signal converter 74 to provide a range voltage signal on line 98 that is linearly proportional to the range from the ranging system antenna 67 to the earth. The construction of the range signal converter 74 is shown in FIG. 10. The range signal converter includes a comparator 100, a coupling capacitor C7, a video threshold adjustment circuit 102, a first delay circuit 103, a first level shifter 104, an inverter 105, a second delay circuit 106, a video blanking switch 107, a second level shifter 108, an edge-triggered flip-flop 109 a low pass filter 110, and a resistance R7.

The video range signal on line 97 is applied through the coupling capacitor C7 to the noninverting input of the comparator 100. The comparator 100 compares the video range signal from line 97 with a reference signal provided to its inverting input by the video threshold adjustment circuit 102 in order to recognize the echo pulses in the video range signal from line 97.

However, the video range signal on line 97 may also contain transmitter "leakage" pulses that have leaked through the circulator 68 to the receiver 72 from the transmitter 69. It is necessary to prevent the comparator 100 from recognizing transmitter leakage pulses on line 97 as echo pulses. Accordingly, a blanking signal is applied to the inverting input of the comparator 100 from the video blanking switch 107 during the time frame of any transmitter leakage pulses. The video blanking switch 107 is controlled in response to the 200 kHz prf square wave sync signal on line 80 from the synchronizer 71. The sync signal from line 80 is first delayed by the first delay circuit 103, then passed through the level shifter 104 and the inverter 105 and then further delayed by the second delay circuit 106 so that the blanking signal provided in response thereto by the video blanking switch 107 extends over the full duration of any transmitter leakage pulse on line 97.

Figure 11:
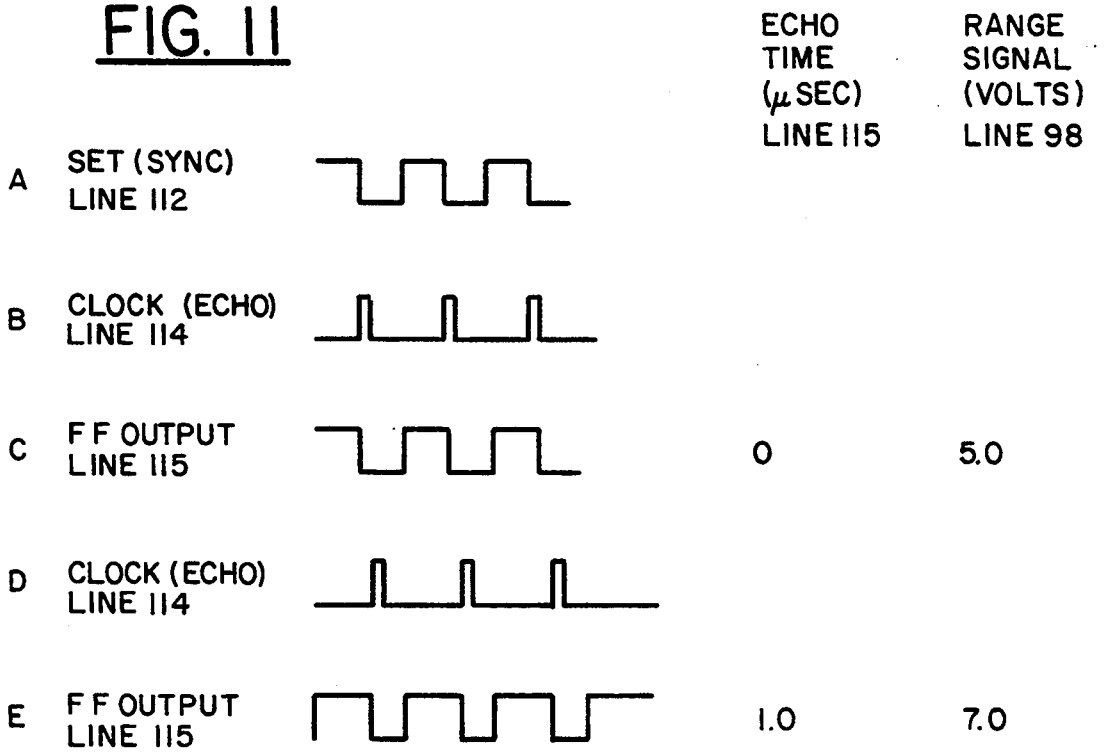
FIGS. 11A through 11E are waveforms of input and output signals for the edge-triggered flip-flop in the range signal converter of FIG. 10.

The delayed sync signal on line 112 from the inverter 105 is provided to the "set" input of the edge-triggered flip-flop 109. The comparator 100 provides a 250 nsec output pulse on line 114 in response to recognizing each echo pulse in the video signal from line 97. The output pulses on line 114 from the comparator 100 are passed through the level shifter 108 to the clock input of the edge-triggered flip-flop 109. The sync pulses on line 112 set the output of the flip-flop 109 to logical "one". The echo pulses on line 114 reset the output of the flip-flop 109 to logical "zero". The output signal of the flip-flop 109 on line 115 is fed through the low pass filter circuit 110 and the resistance R7 to provide a range voltage signal on line 98. The first delay circuit 103 delays the sync signal so that when the distance from the ranging system antenna 67 to the earth is zero feet, the leading edges of the echo pulses on line 114 that clock the flip-flop 109 are coincident with the trailing edges of the sync pulses on line 112 that set the flip-flop, as shown by waveforms B and A respectively in FIG. 11. The time between the trailing edge of a sync pulse and the leading edge of the next echo pulse is referred to as "echo time". When the echo time is zero (as illustrated by the relative positions of waveforms A and B), the waveform of the flip-flop output signal on line 115 is symmetrical, as shown by waveform C in FIG. 11. On the other hand, when the echo time is 1 microsecond (as illustrated by the relative position of waveforms A and D), the waveform of the flip-flop output signal on line 115 becomes non-symmetrical as shown by waveform E in FIG. 11.

Figure 12:
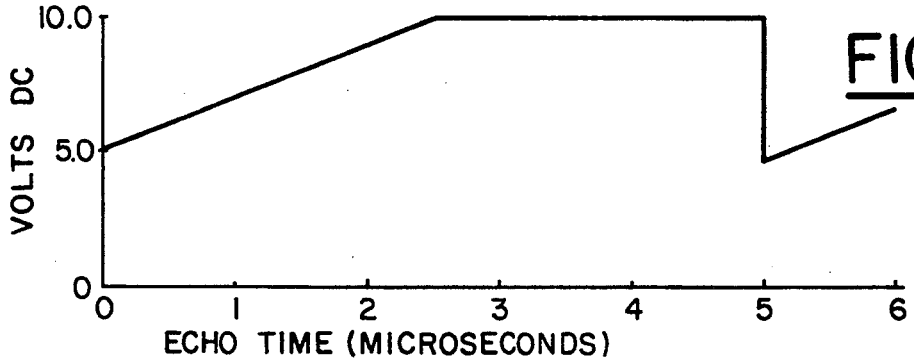
FIG. 12 is a graph illustrating the relationship in the preferred embodiment between echo time and the range voltage signal.
Figure 13:
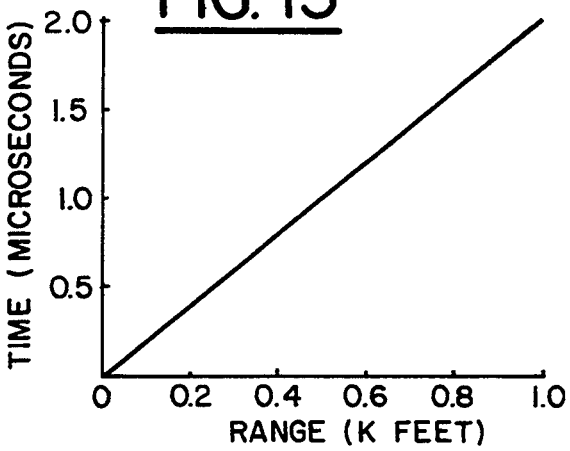
FIG. 13 is a graph illustrating the relationship between echo time and range.
Figure 14:
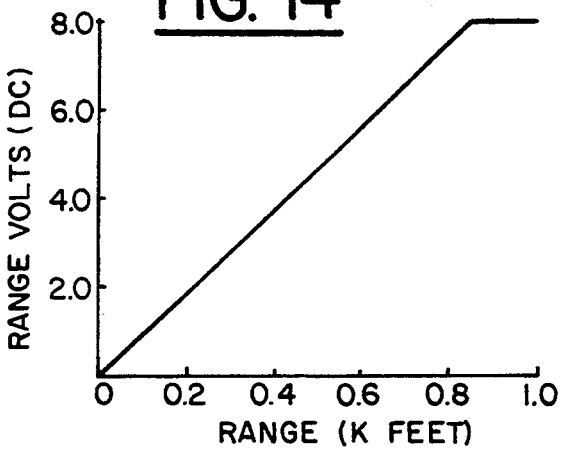
FIG. 14 is a graph illustrating the relationship in the preferred embodiment between range and the range voltage signal.

The threshold of the low pass filter 110 is adjusted to provide a five volt DC range voltage signal on line 98 when the flip-flop output waveform on line 115 is symmetrical. The gain of the low pass filter 110 is adjusted to define a constant of linear proportionality between the echo time and the DC range voltage signal on line 98. The relationship between echo time in microseconds and the D.C. voltage of the voltage range signal on line 98 in the preferred embodiment is illustrated by the graph of FIG. 12. FIG. 13 is a graph of echo time as a function of range for the preferred embodiment. Combining the graphs of FIGS. 12 and 13 yields the graph of FIG. 14 which is a plot of the voltage range signal on line 98 in volts versus the range from the ranging system antenna 67 to the earth in kilofeet for the preferred embodiment.

Figure 15:
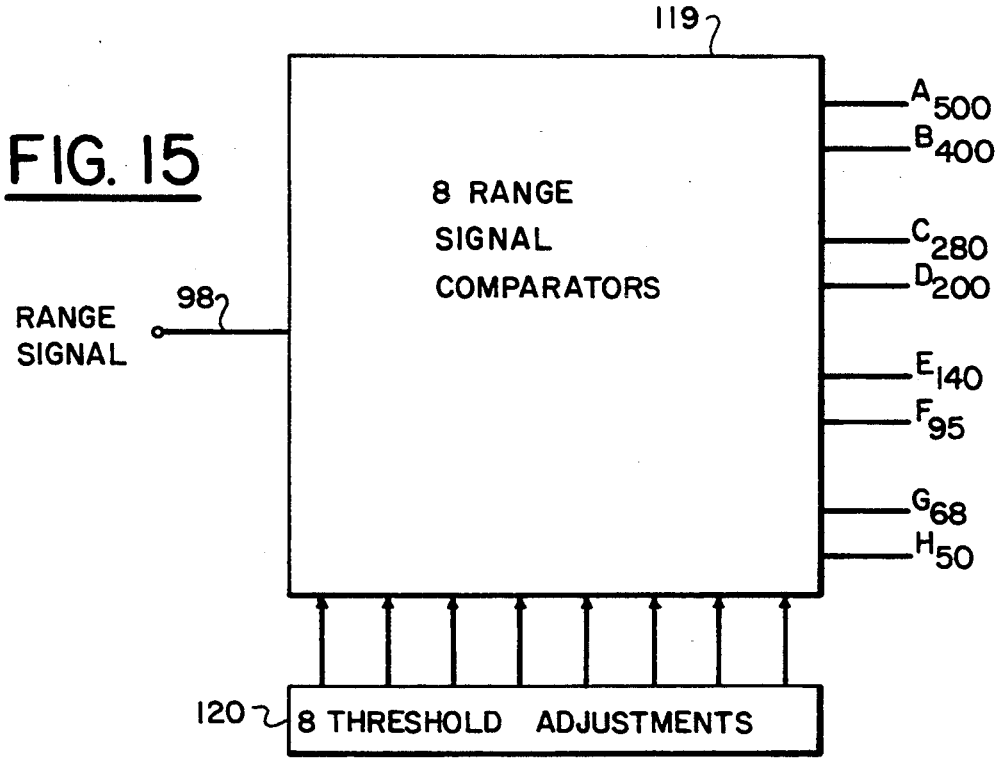
FIG. 15 is a block diagram of the range signal comparator included in the preferred embodiment of FIG. 2.

The range voltage signal is provided on line 98 from the range signal converter to a range signal comparator circuit 118. Referring to FIG. 15, the range signal comparator circuit includes eight comparators 119 for individually comparing the range voltage signal on line 98 with eight different threshold signals provided from a threshold adjustment circuit 120 for providing range determination signals on lines $A_{500}$, $B_{400}$, $C_{280}$, $D_{200}$, $E_{140}$, $F_{95}$, $G_{68}$ and $H_{50}$. The threshold adjustment circuit 120 is adjusted to provide voltage threshold signals to the respective eight comparators 119 having voltage levels corresponding to 500 feet, 400 feet, 280 feet, 200 feet, 140 feet, 95 feet, 68 feet and 50 feet respectively in accordance with the graph of FIG. 14. When the range voltage signal on line 98 becomes less than the voltage corresponding to 500 feet in accordance with the graph of FIG. 14, a 500 foot range determination signal is provided on line $A_{500}$. The subscripts related to the range determination signal output lines from the comparators 119 indicate the range represented by the range voltage signal on line 98 below which a range determination signal is provided on the respective output lines from the comparator 119. The range determination signals from the range signal comparator are provided to a fire control logic circuit 122 and to the weapon system 123 that is supported by the platform 20.

When the range signal comparator circuit 118 determines that the range to the earth is less than 500 feet, a range determination signal is provided on line $A_{500}$ to the weapon system 123 for enabling the weapon to be armed.

Figure 16:
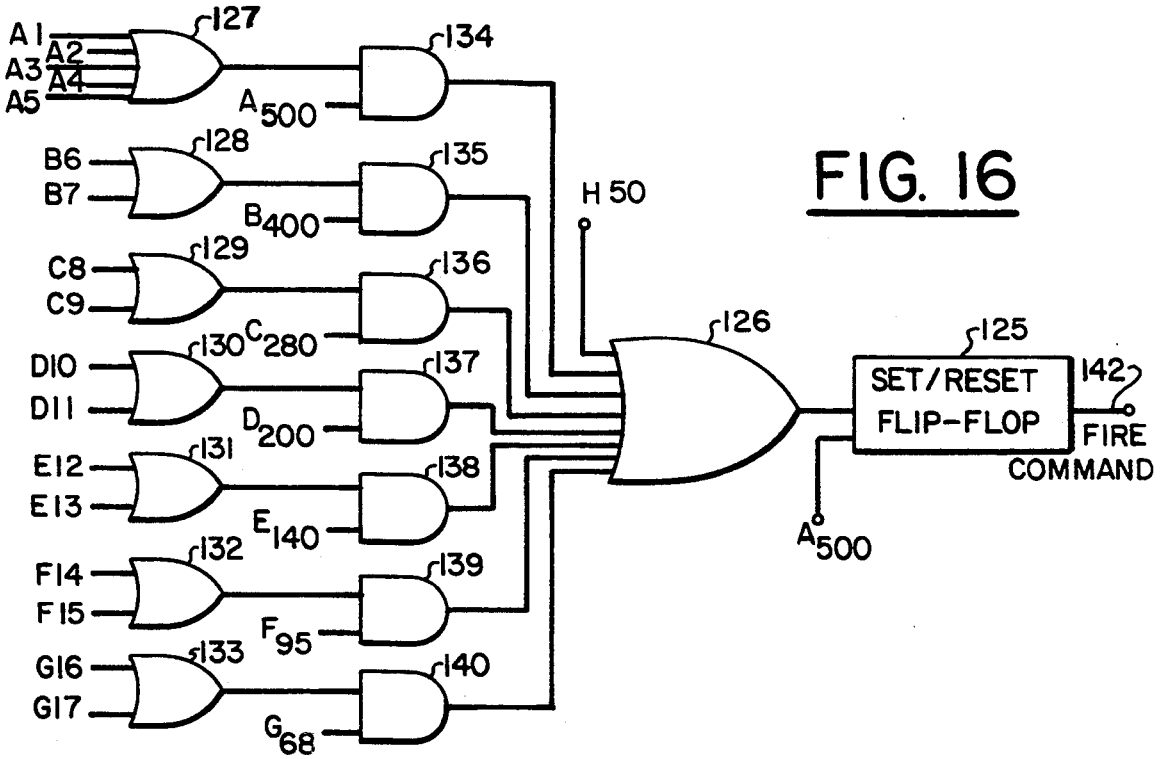
FIG. 16 is a schematic diagram of the fire control logic circuit included in the preferred embodiment of FIG. 2.

The fire control logic circuit 122, which is shown in FIG. 16, includes a set/reset flip-flop 125, a first OR gate 126, seven additional OR gates 127, 128, 129, 130, 131, 132 and 133 and seven AND gates 134, 135, 136, 137, 138, 139 and 140.

The output lines 60 of the target detectors 35 in the detector channels containing the first group of detector elements A1, A2, A3, A4 and A5 are connected to inputs of the OR gate 127. The output lines 60 of the target detectors 35 in the detector channels containing the adjacent group of detector elements B6 and B7 are connected to the inputs of the OR gate 128. The output lines 60 of the target detectors 35 in the detector channels containing the next adjacent group of detector elements C8 and C9 are connected to the inputs of the OR gate 129. The output lines 60 of the target detectors 35 in the detector channels containing the following adjacent group of detector elements D10 and Dll are connected to the inputs of the OR gate 130. The output lines 60 of the target detectors 35 in the detector channels containing the succeeding adjacent group of detector elements E12 and E13 are connected to the inputs of the OR gate 131. The output lines 60 of the target detectors 35 in the detector channels containing the next outer adjacent group of detector elements F14 and F15 are connected to the inputs of the OR gate 132. The output lines 60 of the target detectors 35 in the detector channels containing the outer adjacent group of detector elements G16 and G17 are connected to the inputs of the OR gate 133.

The output lines of the OR gates 127, 128, 129, 130, 131, 132 and 133 are respectively coupled to one of the inputs of the AND gates 134, 135, 136, 137, 138, 139 and 140. The second inputs of the AND gates 134, 135, 136, 20 137, 138,139 and 140 are respectively connected to lines $A_{500}$, $B_{400}$, $C_{280}$, $D_{200}$, $E_{140}$. $F_{95}$ and $G_{68}$ from the range signal comparator circuit 118.

The output lines of the AND gates 134, 135, 136, 137, 138, 139 and 140 and line $H_{50}$ from the range signal comparator circuit 118 are all connected to the inputs of the OR gate 126.

The output of the OR gate 126 is provided to the clock input of the flip-flop 125.

When the platform 20 descends to less than 500 feet from the earth in the direction that the antenna 67 is aimed, the 500 foot range determination signal is provided on line $A_{500}$ to set the flip-flop 125. When the flip-flop is clocked by a signal from the OR gate 126, a fire command signal is provided from the output of the flip-flop 125 on line 142 to the weapon system 123 for enabling the weapon to be fired.

The AND gate 134 is also enabled by the range determination signal on line $A_{500}$ when the platform 20 descends to 500 feet so that if a valid target subsequently is detected by any of the detector elements A1, A2, A3, A4 and A5, the flip-flop 125 is clocked and a fire command signal is provided on line 142.

When the platform further descends to less than 400 feet, the 400 foot range determination signal is provided on line $B_{400}$ to enable the AND gate 135 so that if a valid target signal subsequently is detected by any of the detector elements B6 or B7 the flip-flop 125 is clocked and a fire command signal is provided on line 142.

As the platform continues to descend the additional AND gates 136, 137, 138, 139 and 140 are enabled incrementally in response to the range determination signals on lines $C_{280}$, $D_{200}$, $E_{140}$, $F_{95}$ and $G_{68}$ respectively.

If the fire command signal has not been provided on line 142 by the flip-flop 125 in response to detection of a valid target by any of the detector elements by the time when the platform descends to 50 feet, the 50 foot range determination signal provided on line $H_{50}$ causes a fire command signal to be provided on line 142.

Accordingly, the weapon is enabled to be fired in response to target detection signals in only the detection channels corresponding to the first group of detectors A1, A2, A3, A4 and A5 when the ranging means first determines that said range is less than 500 feet and in further response to target detection signals in detection channels corresponding incrementally to progressively outwardly located groups of detector elements as the ranging system determines that the range is decreased to progressively smaller intermediate predetermined distances that are greater than 50 feet so as to increase the angular field of view of the detector array 30 as the platform 20 descends between 500 feet and 50 feet.

We claim:

1. A system for controlling the arming and firing of a weapon that is suspended from a parachute at an oblique angle and spun so as to be aimed over a rotational scanning pattern on the earth as the parachute descends toward the earth, comprising a platform for supporting the weapon so that the weapon is aimed in a predetermined direction relative to the platform;

detection means supported by the platform and aimed in the same direction as the weapon for detecting predetermined radiation characteristics from targets of opportunity;

ranging means supported by the platform and aimed in the same direction as the weapon for determining the range to the earth in said direction;

first means coupled to the ranging means for enabling the weapon to be armed in response to the ranging means determining that the range to the earth in the direction that the weapon is aimed is less than a first predetermined distance; and second means coupled to the detection means and the ranging means for enabling an armed weapon to be fired in response to either the detection means detecting said predetermined radiation characteristics or the ranging means determining that the range to the earth in the direction that the weapon is aimed is less than a second predetermined distance that is shorter than the first predetermined distance.

2. A system according to claim 1, wherein the detection means includes a linear array having a number of groups of detector elements of different sizes including a first group located in the middle portion of the array and having the smallest size elements, and additional adjacent groups each of which has two elements respectively located adjacent opposite ends of the adjacent inner group with the two elements being larger than the elements in the adjacent inner group;

wherein the detection means further includes separate detector channels for each detector element for providing separate target detection signals in response to the respective detectors detecting said predetermined radiation characteristics; and wherein the second means includes logic means coupled to the separate detector channels and to the ranging means for enabling the weapon to be fired in response to target detection signals in only the detection channels corresponding to the first group of detectors when the ranging means first determines that said range is less than the first predetermined distance, and in further response to target detection signals in detection channels corresponding incrementally to progressively outwardly located groups of detector elements as the ranging means determines that said range is decreased to progressively smaller intermediate predetermined distances that are greater than the second predetermined distance so as to increase the angular field of view of the detector array as the parachute descends between the first and second predetermined distances.

3. A system according to claim 1, wherein the detection means includes a plurality of detector elements;

separate detector channels for each detector element for providing separate detection signals from each detector element and for comparing each detection signal to a low threshold signal to determine whether the detection signal exceeds a low threshold representative of a said predetermined radiation characteristic; and means for amplifying a detection signal from one of the detectors for providing as the low threshold signal a signal having a predetermined minimum signal-to-noise ratio in relation to a detection signal that is responsive to background noise detected in the absence of a target having the predetermined radiation characteristics.

4. A system according to claim 1 wherein the predetermined radiation characteristics include a low level that detected radiation must exceed and a high level that detected radiation must not exceed, wherein the detection means includes means for providing a low threshold signal representative of the low radiation level;

means for providing a high threshold signal representative of the high radiation level;

a detector element;

a detector channel for providing a detection signal from the detector element, and including a first comparison means for comparing the detection signal to a low threshold signal to provide a target detection signal when the compared detection signal exceeds the low threshold signal;

a second comparison means for comparing the detection signal to the high threshold signal to provide a blanking signal when the compared detection signal exceeds the high threshold signal;

means responsive to the blanking signal for preventing the first comparison means from providing a target detection signal; and means for delaying the provision of the detection signal to the first comparison means until after the comparison of the detection signal with the high threshold signal by the second comparison means.

5. A system according to claim 4, wherein the means for delaying the provision of the detection signal to the first comparison means are adapted for amplifying the detection signal for comparison with the low-threshold signal in excess of the amplification of the detection signal provided to the second comparison means for comparison with the high threshold signal.

* * * * *